US009564108B2

(12) United States Patent
Yao

(10) Patent No.: US 9,564,108 B2
(45) Date of Patent: Feb. 7, 2017

(54) VIDEO FRAME PROCESSING ON A MOBILE OPERATING SYSTEM

(71) Applicant: Amlogic Co., Ltd., Santa Clara, CA (US)

(72) Inventor: Ting Yao, San Jose, CA (US)

(73) Assignee: Amlogic Co., Limited, Hong Kong (HK)

( * ) Notice: Subject to any disclaimer, the term of this patent is extended or adjusted under 35 U.S.C. 154(b) by 208 days.

(21) Appl. No.: 14/518,764

(22) Filed: Oct. 20, 2014

(65) Prior Publication Data

US 2016/0111060 A1 Apr. 21, 2016

(51) Int. Cl.
*G09G 5/36* (2006.01)

(52) U.S. Cl.
CPC ..... *G09G 5/363* (2013.01); *G09G 2360/18* (2013.01); *G09G 2370/12* (2013.01)

(58) Field of Classification Search
None
See application file for complete search history.

(56) References Cited

U.S. PATENT DOCUMENTS

2004/0160446 A1* 8/2004 Gosalia ..... G06F 9/4843 345/503
2010/0115023 A1* 5/2010 Peled ..... G06F 17/3089 709/203
2010/0254603 A1* 10/2010 Rivera ..... G06F 3/1415 382/173
2011/0141355 A1* 6/2011 Boak ..... H04N 5/04 348/513
2012/0092335 A1* 4/2012 Kim ..... H04N 13/0029 345/419
2014/0270722 A1* 9/2014 Wang ..... H04N 21/443 386/355
2015/0067186 A1* 3/2015 Kuhn ..... H04L 65/607 709/231

* cited by examiner

*Primary Examiner* — Nurun N Flora
(74) *Attorney, Agent, or Firm* — Venture Pacific Law, PC

(57) ABSTRACT

A method for rendering video frames by a computing device having a software stack with an application layer and a kernel layer comprises various steps. First, a system reference time is initialized. A triggering of an interrupt signal in the kernel layer is waited for. Next, it is determined whether to update the system reference time as a function of a render function from the application layer. A next video frame in the kernel layer is rendered by the computing device as a function of the determined system reference time and the next video frame. The steps after the initializing step and starting at the waiting step are recursively performed.

15 Claims, 7 Drawing Sheets

VIDEO FRAME PROCESSING ON A MOBILE OPERATING SYSTEM

FIELD OF INVENTION

The disclosure relates to processing video frames, and, more particularly, to timing control for rendering video frames by a computing device running a mobile operating system.

BACKGROUND

A computing device having a mobile operating system, e.g., Android, Blackberry, iOS, Windows Phone, Firefox OS, Sailfish OS, Symbian, Ubuntu Touch OS, etc., can run various software applications ("apps"), e.g., video game apps, video streaming apps, news reader apps, etc. The mobile operating system can be installed onto the computing device, e.g., a smart phone, tablet, laptop, personal digital assistant, set-top box, portable computer, etc. The software applications can run on a higher software layer than the mobile operating system.

Due to the complexity of the apps and the amount of video processing for the apps, timely generation of video graphics by the computing device has become problematic; especially when more flexibility is provided from the media framework to the application layer to allow the use of video decoders and to control the video frame rendering timing from a user space level. In particular, the computing device may not be able to fulfill requests for video decoding and video rendering for the apps in a timely fashion, causing frame jumps.

For instance, a gaming app running on the computing device can be programmed in a programming language such as C++, java, etc. The gaming app runs on an application layer, but ultimately uses kernel layer function calls to perform decoding and rendering of the video graphics of the gaming app. The computing device processes video decoding function calls via a video decoder of the computing device. The decoded video frames are stored in memory of the computing device and are rendered via a rendering module of the computing device at the selected time for rendering.

A processor of the computing device (e.g., a graphics processor unit ("GPU") or other computer processor) can be used to implement the decoder and the rendering module. However, as the processor is inundated with various other computing threads, the processor may not be able to decode and render the video frames at an appropriate rate to properly display the video frames on a display of the computing device. This can cause frame jumping when the video data is viewed on the display.

Frame jumping is further exacerbated by the extended amount of time that it takes for the render function calls from the application layer to eventually reach the kernel layer. Typically, the gaming app sends the latest-to-be-rendered frame with an application programming interface ("API") provided from the media framework layer to lower layers of the software stack (e.g., to the kernel layer) to perform the actual rendering at the kernel layer. However, if video rendering falls behind time stamps of the video frames to be rendered, then the video frames may not be rendered at the proper time and lead to video frame jumps. Video frame jumps can lead to non-smooth video playback, which is undesirable when viewed by a user.

Therefore, it is desirable to provide methods, apparatuses, and systems for timing control of video rendering by a computing device having a mobile operating system to reduce or eliminate frame jumps.

SUMMARY OF INVENTION

Briefly, the disclosure relates to a method for rendering video frames by a computing device having a software stack with an application layer and a kernel layer, comprising the steps of: initializing a system reference time; waiting until an interrupt signal is triggered in the kernel layer; determining whether to update the system reference time as a function of a render function from the application layer; and rendering a next video frame in the kernel layer by the computing device as a function of the determined system reference time and the next video frame, wherein the steps after the initializing step and starting at the waiting step are recursively performed.

DESCRIPTION OF THE DRAWINGS

The foregoing and other aspects of the disclosure can be better understood from the following detailed description of the embodiments when taken in conjunction with the accompanying drawings.

DETAILED DESCRIPTION OF THE EMBODIMENTS

In the following detailed description of the embodiments, reference is made to the accompanying drawings, which form a part hereof, and in which is shown by way of illustration of specific embodiments in which the disclosure may be practiced.

The present disclosure provides methods, systems, and apparatuses related to timing control for rendering video frames by an application of a computing device running a mobile operating system. In cases where the application has control of rendering video frames from the user space, the application is given a greater time window (or more time margin) to meet the critical timing requirement for video rendering. A tunnel mode for video rendering, which is a kernel level process, aids the application in the user space level by continually rendering frames in accordance with the tunnel mode. However, when a time stamp of a rendering function call from the application is greater than a system reference time in the kernel level by a predefined threshold, the video frame rendering in the tunnel mode can be stopped or paused. In this manner, timing control for rendering video frames can be implemented using a hybrid method where the tunnel mode and the user space application-programming-interface ("API") rendering functions can be used simultaneously in the computing device. The following figures and detailed descriptions will aid in explaining the present disclosure and its core ideas.

Figure 1:
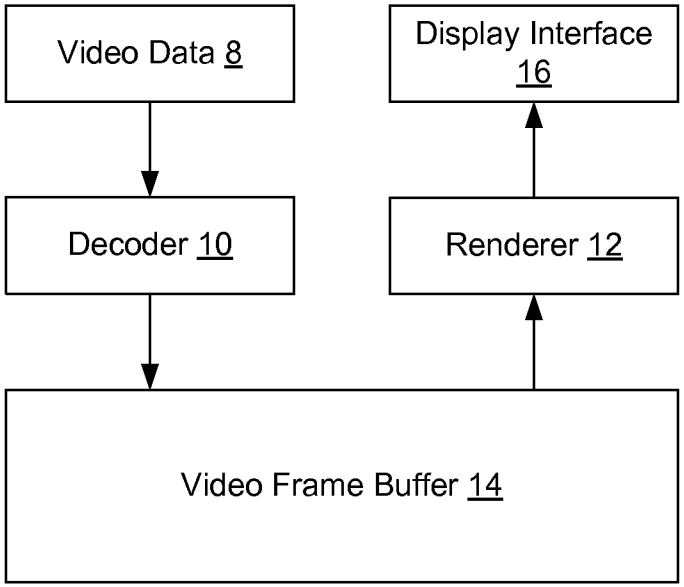
FIG. 1 illustrates a block diagram for decoding and rendering video data on a computing device.

FIG. 1 illustrates a block diagram for decoding and rendering video data on a computing device. A computing device can comprise a decoder 10, a renderer 12, a video frame buffer 14 (or other memory device), and a display interface 16 for decoding and rendering video data 8 onto a display (not shown). The display can be an external display device connected to the computing device or an internal display of the computing device.

The video data 8 can be inputted to the decoder 10. The decoder 10 decodes the video data into video frames. The video frames can be stored in a video frame buffer 14 (or other memory) of the mobile device for later rendering or passed directly to the renderer 12 for rendering. The renderer 12 renders the video frames to the display via the display interface 16. The video frames must be rendered at a proper time to be displayed correctly and for smooth video playback. The display interface 16 can provide the rendered video frames in a high definition multimedia interface ("HDMI") interface, an analog component video output interface, and/or other video display format for the rendered video frames to be displayed properly.

Figure 2:
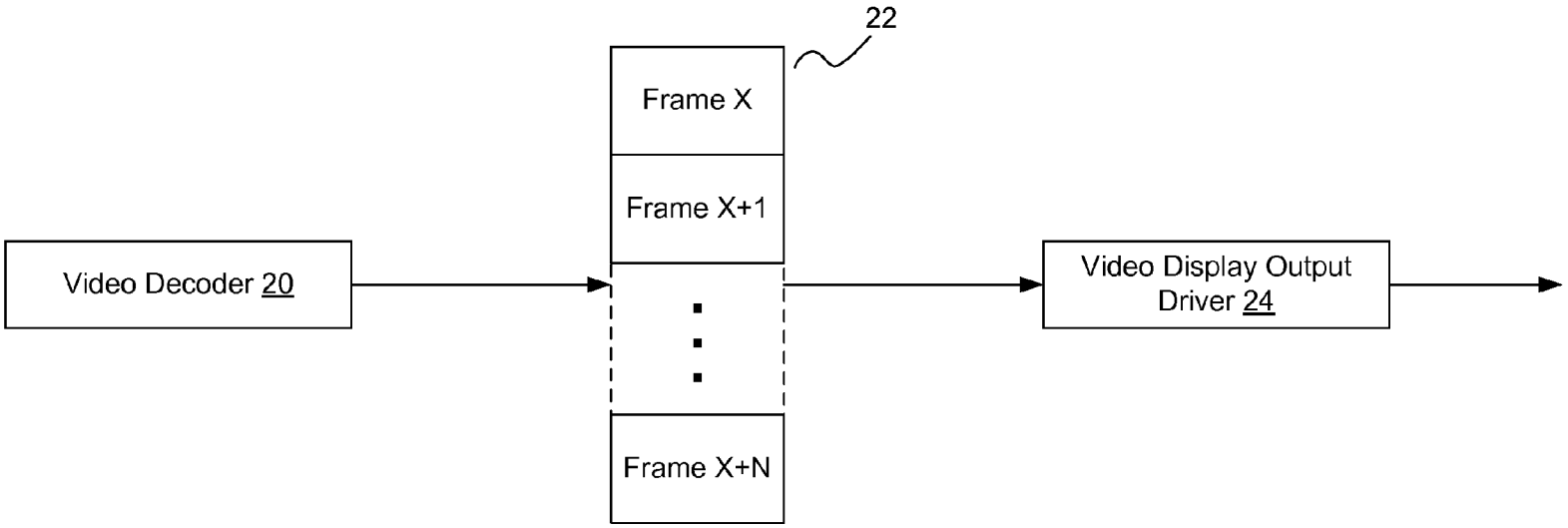
FIG. 2 illustrates a tunnel mode in a kernel space of a computing device for decoding and rendering video data.

FIG. 2 illustrates a data work flow of a tunnel mode in a kernel space of a computing device for decoding and rendering video data. A decoder 20 takes video data to generate the decoded video frames. The decoded video frames are placed in a memory of the computing device. A graphical processing unit ("GPU"), not shown, can apply transforms and compose the decoded video frames into a video frame buffer 22. The video frames can then be rendered from the video frame buffer 22 at the proper time for display via the video display output driver 24. The video display out driver 24 can read the video frames 22 for output to the proper output display port.

Figure 3:
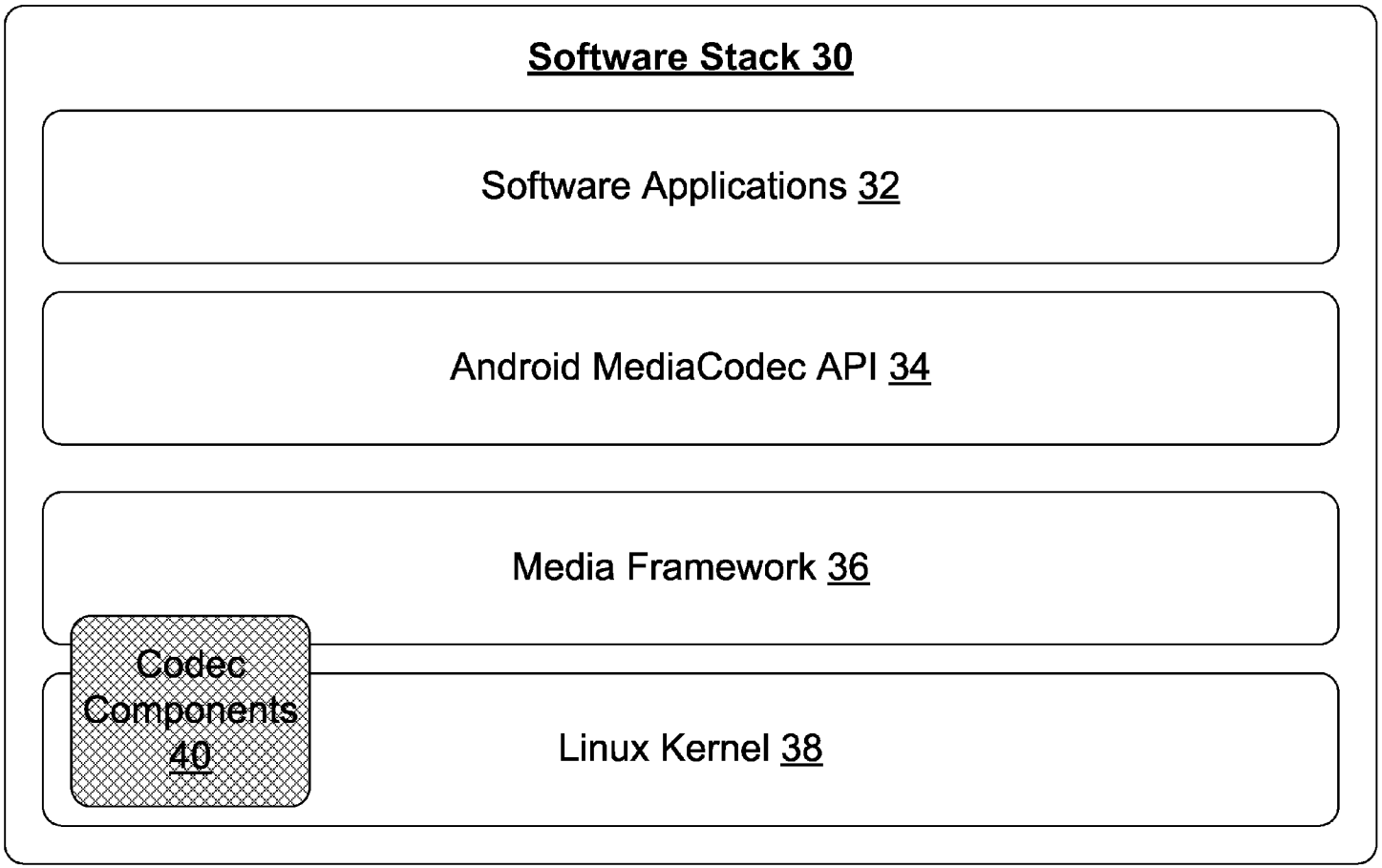
FIG. 3 illustrates a diagram of a software stack of a computing device having a mobile operating system, e.g., an Android system.

FIG. 3 illustrates a diagram of a software stack of a computing device having a mobile operating system. The computing device can have a mobile operating system installed and running on the computing device. A software stack 30 of the computing device comprises software applications 32, an android mediacodec API 34, a media framework 36 (e.g., an android media framework), a linux kernel 38, and codec components 40.

The linux kernel 38 is a bottom most software layer of the computing device to provide the most basic system functionality like process management, memory management, device management (e.g., camera, key pad, display, etc.), device drivers, networking, and/or other system functionality. The media framework 36 can be a second lowest layer that provides a virtual machine that is specifically designed and optimized for android. The media framework 36 also has core libraries that can enable android application developers to write software applications using standard java language. The android mediacodec API 34 layer allows for applications in the software applications 32 layer to access the codec components 40 installed in the system and to control the rendering of the output. The software applications 32 layer comprises the apps that run on the computing device.

The codec components 40 serve as an interface having two parts. The first part is in the user space connected to the media framework 36 and a second part in the kernel space. When the application sends data (e.g., enqueue input data, etc.) to the codec components 40 through the media codec API 34, the codec components 40 interface with the native layer of the media framework 36 and any third party libraries. The data from the codec components 40 is routed to the decoder components and other components in the kernel layer.

From a software standpoint, an app uses an application programming interface to communicate with the lower layers in the software stack. For instance, the android system uses the mediacodec API. The application layer is primarily written in the java programming language. The native layer (or media framework layer 36) is typically written in the C programming language. The android media framework layer is a layer higher than the kernel layer and serves as the middleware layer to manage multimedia features in the respective system. The mediacodec API is part of the media framework and can be used to communicate between the application layer of the software stack and the lower layers, e.g., the kernel layer.

Figure 4:
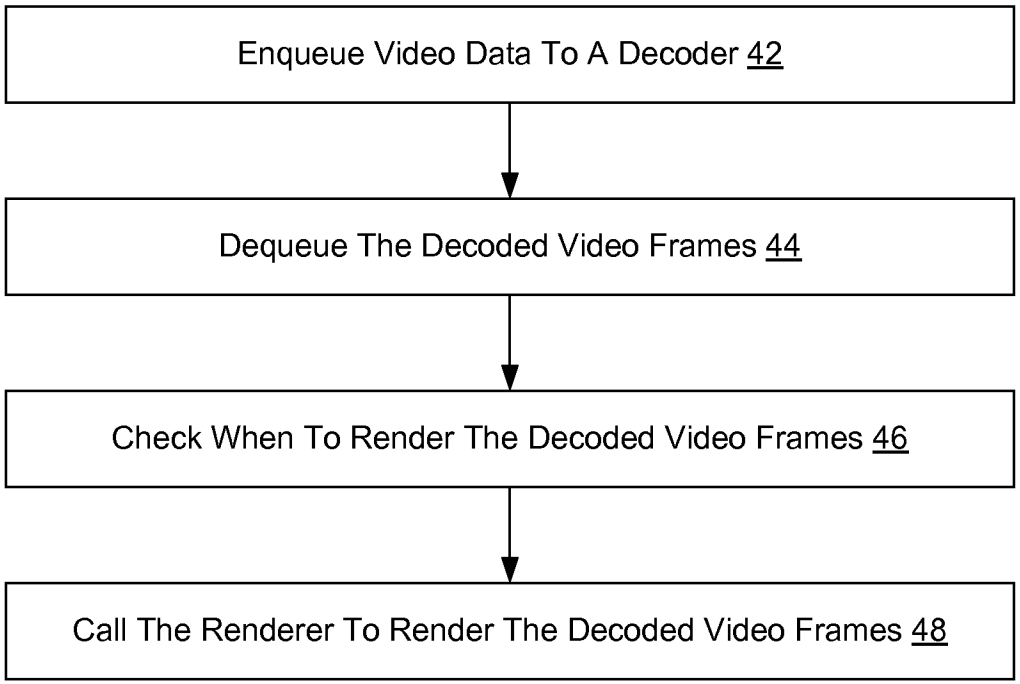
FIG. 4 illustrates a flow chart for decoding and rendering video data by an application of a mobile operating system.

FIG. 4 illustrates a flow chart for decoding and rendering video data by an application of a mobile operating system in a user space. An app in the application layer can access codec components using the mediacodec API. Under the android system, the app controls the video rendering and the video decoding for graphics for the app. The app gets video data from a media source, which could be a local media file, online streaming, etc. The application determines video format, audio format, resolution of the video, and/or other information regarding the video data and configure the codec components via the mediacodec API. The video data and the audio data can be demuxed and processed separately.

The app can then call a mediacodec function to enqueue the video data to a decoder component's input port 42. The retrieved video data from memory is inputted to the decoder. The decoder can decode that retrieved video data and store the decoded video data in the memory.

Next, the app calls a dequeue function 44 to get the decoded video frames. The decoded video frames can be dequeued from the decoder's output port or from the memory. The decoded video frames are then readied to be inputted (or inputted) to a renderer for rendering at the appropriate time. The pixel data of the video frames stay in the decoded video frame buffer but the reference is passed back to the application side with the time stamp information attached to each frame, so that the application has a queue of references of decoded video frames to render. The mediacodec API is designed to give the application more flexibility so the application can decide when a video frame can be rendered based on audio video synchronization management, network streaming buffering level, etc.

Once the decoded video frames are ready, the app can check when to render the decoded video frames 46. Typically, the respective computing device checks the time stamp for each of the video frames according to a reference clock when the check function is issued. If the time stamp of a current video frame is within a time range before the next video frame is to be rendered, then the mediacodec's render function is invoked to render the frame. Each video frame has a time stamp which determines when the frame should be displayed. For instance, if the movie is 24 frames per second, the time length between video frames is $1/24$ of a second. When and how the frame is rendered can be fully controlled by application to provide a measure of flexibility.

When a decoded video frame is to be rendered, the app calls a render function 48 to call the renderer to render the decoded video frame. The rendered frames can be placed in a video frame buffer (or other memory). From there, the display interface can output the rendered frames to the display of the computing device. The assumption from the mediacodec API is that when the render function is invoked, the implementation of the mediacodec's render is fast enough to finish before the next V-synchronized signal triggers and is ready to change to the new frame.

The render function is invoked from the application and is programmed in the java language. Thus, the render function goes through a java virtual machine and passes to the native layer of the media framework. When the rendering function is called, timing cannot be guaranteed or assured since functions from the user space may incur overhead delay before reaching the kernel layer. Furthermore, the processor of the computing device may be overloaded such that immediate processing of the rendering functions may be delayed. When the application calls the rendering function, the computing device may have multiple running CPU threads to read data from the media source, feed data to the decoder, and get decoded output from the decoder at same time, as well as audio processing in parallel.

Figure 5:
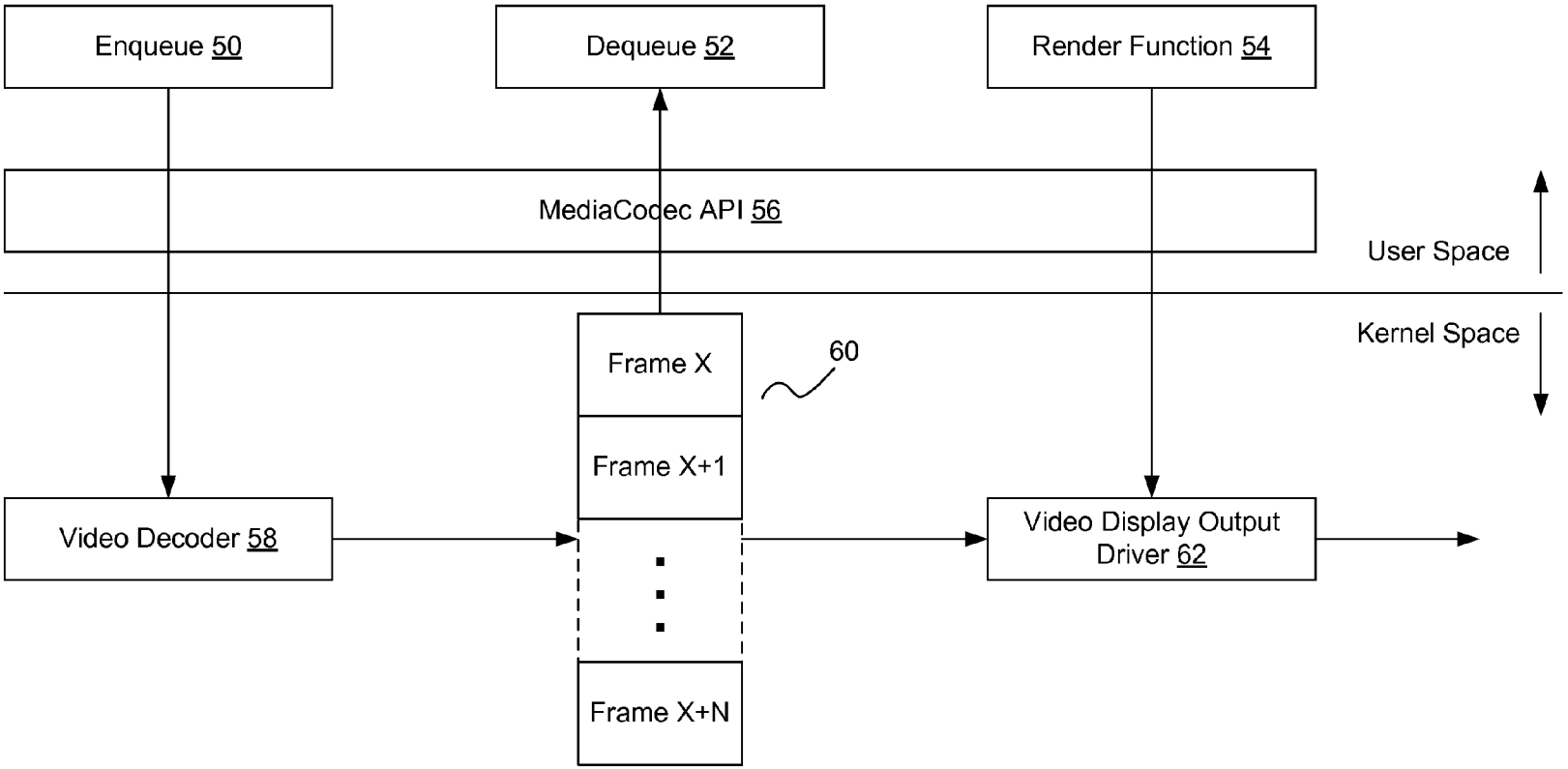
FIG. 5 illustrates a block diagram of a hybrid system for decoding and rendering video data in a user space and a kernel space.

FIG. 5 illustrates a block diagram of a hybrid system for decoding and rendering video data in a user space and a kernel space. In a hybrid system, the tunnel mode for rendering and decoding are processed in a similar manner by a video decoder 58, a video frame buffer 60, and a video display output driver 62. Applications in the user space of the software stack call android mediacodec API functions to control the decoding and rendering of the kernel layer tunnel mode. For instance, mediacodec API 56 function calls for enqueue 50, dequeue 52, and render 54 can be called to control the decoding and rendering of the kernel space from the user space.

In the hybrid system, the tunnel mode renders video frames from the video frame buffer 60 at the proper timing regardless of the rendering functions from the applications. However, time stamps from the render functions are compared with the time stamp of a system reference time. When the system reference time exceeds the time stamp of the render function by a predefined threshold, the rendering in the tunnel mode is paused until time when the system reference time does not exceed the time stamp of the render function by the predefined threshold.

Figure 6:
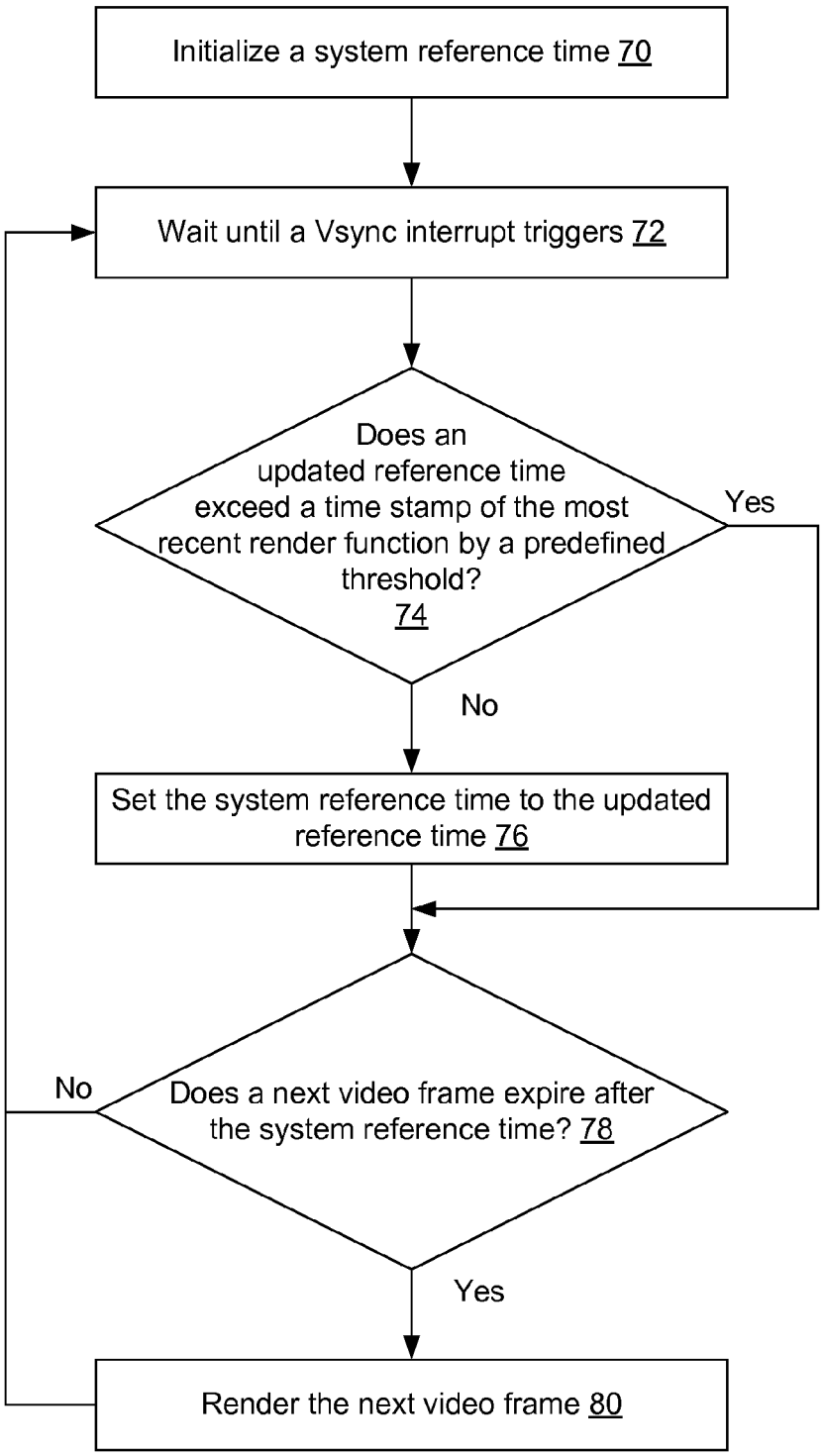
FIG. 6 illustrates a flow chart of a hybrid system for decoding and rendering video data in a user space and a kernel space.

FIG. 6 illustrates a flow chart of a hybrid system for decoding and rendering video data in a user space and a kernel space. A video synchronizing signal ("Vsync") is triggered periodically with the refresh rate of the video output. For example, the 1080P 60 Hz output mode will generate Vsync 60 times per second. Vsync can be used for incrementing a system reference time, where the system reference time is used for timing control of the rendering function in the hybrid system for decoding and rendering. The following flow chart will expand on this as an example of the present disclosure.

First, a system reference time is initialized 70. The system reference time can be initialized to correspond to the first rendered video frame or to another indicator for the beginning of the video frames. Next, the system waits until a Vsync is triggered 72.

Once a Vsync is triggered, the system determines whether to update the system reference time as a function of a render function from the application layer. For instance, does an updated system reference time exceed a time stamp of the most recent render function by a predefined threshold 74? The updated system reference time can be the current system reference time plus an amount of time between two consecutive Vsync's. The updated system reference time can also be referred to as the next system reference time. The predefined threshold can be an amount of time for rendering a number of video frames (e.g., 2-3 frames). If the updated system reference time does not exceed the time stamp of the most recent render function, the system reference time can be set to the updated system reference time 76. If the system reference time does exceed the time stamp of the most recent render function by the predefined threshold, then the system reference time is not updated.

Next, it is determined if any video frames are to be rendered. In order to make this determination, does a next video frame expire after the system reference time 78? If the next video frame does expire, then the next video frame is rendered 80. If not, then the method restarts at the waiting step 72 and recursively processes other video frames and other render functions. During this recursion, the system reference time is a global value and can increase with every recursion depending on whether step 76 for setting the system reference time is reached in a respective recursion.

Figure 7:
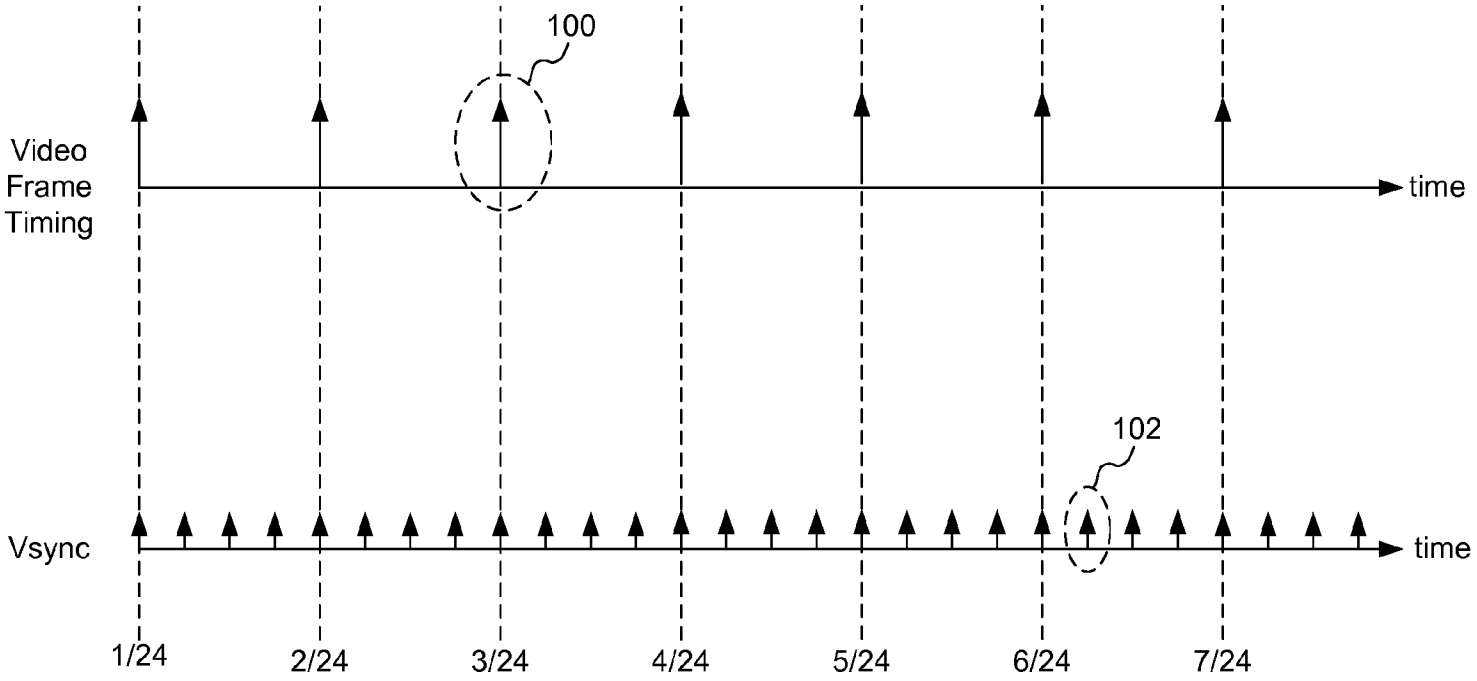
FIG. 7 illustrates a timing diagram for determining when to cease rendering video frames.

FIG. 7 illustrates a timing diagram for determining when to cease rendering video frames. For video frame timing, the video frames can be rendered at a frame rate of the video. For instance, assuming the video is at a rate for 24 frames per second, at each 1/24 of a second, a frame should be rendered onto a display. Therefore, each 1/24 sec a next frame should be rendered. At time 1/24 sec., a first frame is rendered along the video frame timing; at time 2/24 sec., a second frame is rendered along the video frame timing; at time 3/24 sec, a third frame is rendered along the video frame timing; and etc.

The Vsync of the kernel layer can run at a higher frequency and update the system reference time for each Vsync that is triggered as long as the system reference time does not exceed the current time stamp of the most recent render function by a predefined threshold. For instance, the Vsync can run at a 1/5 of the rate (or any other rate) of the frame rate of 1/24 sec. For every 1/24 sec., the Vsync can be triggered five times, as illustrated on the lower line of the graph.

When a rendered function call for a decoded frame is received, the rendered function call has a time stamp. If the current system reference time exceeds the time stamp of the render function call by a predefined threshold, the system reference time is no longer incremented, effectively pausing or stopping the rendering of the video frames. For instance, assuming a render function call has the time stamp 100 at 3/24 sec., a current system reference time is at around the time stamp 102, and a predefined threshold for cease rendering is at 3 frames or 3/24 sec., then if and when the current system reference time reaches greater than the predefined threshold from the time stamp of the most recent rendering function call, then the rendering of the video frames in the kernel layer will cease or pause.

While the disclosure has been described with reference to certain embodiments, it is to be understood that the disclosure is not limited to such embodiments. Rather, the disclosure should be understood and construed in its broadest meaning, as reflected by the following claims. Thus, these claims are to be understood as incorporating not only the apparatuses, methods, and systems described herein, but all those other and further alterations and modifications as would be apparent to those of ordinary skilled in the art.

I claim:

1. A method for rendering video frames by a computing device having a software stack with an application layer and a kernel layer, comprising the steps of:

initializing a system reference time;

waiting until an interrupt signal is triggered in the kernel layer;

determining whether to update the system reference time as a function of a render function from the application layer, wherein the system reference time is set to equal a next system reference time when the next system reference time does not exceed a time stamp of the render function by a predefined threshold; and rendering a next video frame in the kernel layer by the computing device as a function of the determined system reference time and the next video frame, wherein the steps after the initializing step are recursively performed.

2. The method of claim 1 wherein the interrupt signal is periodic and wherein the next system reference time is equal to the system reference time plus a period of time between two consecutive interrupt signals.

3. The method of claim 1 wherein in the determining step, if a next system reference time exceeds a time stamp of the render function by a predefined threshold, the system reference time is not updated.

4. The method of claim 1 wherein in the rendering step, if the next video frame expires after the system reference time, the next video frame is rendered.

5. The method of claim 1 wherein in the rendering step, if the next video frame does not expire after the system reference time, the next video frame is not rendered, and wherein the waiting, determining, and rendering steps are recursively performed.

6. The method of claim 1 wherein the computing device comprises a software application that runs in the application layer, and wherein the software application generates the render function.

7. The method of claim 1 wherein the system reference time is a cumulative value, and wherein the system reference time is a global value that is carried on to a next recursion of the waiting, determining, and rendering steps.

8. A method for rendering video frames by a computing device having a software stack with an application layer and a kernel layer, comprising the steps of:

initializing a system reference time;

waiting until an interrupt signal is triggered in the kernel layer;

determining whether to update the system reference time as a function of a render function from the application layer, wherein if a next system reference time does not exceed a time stamp of the render function by a predefined threshold, then the system reference time is set to equal the next system reference time, else, the system reference time is not updated; and rendering a next video frame in the kernel layer by the computing device as a function of the determined system reference time and the next video frame, wherein if the next video frame expires after the system reference time, the next video frame is rendered, and wherein the steps after the initializing step are recursively performed.

9. The method of claim 8 wherein the interrupt signal is periodic and wherein the next system reference time is equal to the system reference time plus a period of time between two consecutive interrupt signals.

10. The method of claim 8 wherein in the rendering step, if the next video frame does not expire after the system reference time, the next video frame is not rendered, and wherein the waiting, determining, and rendering steps are recursively performed.

11. The method of claim 8 wherein the computing device comprises a software application that runs in the application layer, and wherein the software application generates the render function.

12. The method of claim 8 wherein the system reference time is a cumulative value, and wherein the system reference time is a global value that is carried on to a next recursion of the waiting, determining, and rendering steps.

13. A method for rendering video frames by a computing device having a software stack with an application layer and a kernel layer, comprising the steps of:

initializing a system reference time;

waiting until an interrupt signal is triggered in the kernel layer;

determining whether to update the system reference time as a function of a render function from the application layer, wherein if a next system reference time does not exceed a time stamp of the render function by a predefined threshold, then the system reference time is set to equal the next system reference time, else the system reference time is not updated; and rendering a next video frame in the kernel layer by the computing device as a function of the determined system reference time and the next video frame, wherein if the next video frame expires after the system reference time, then the next video frame is rendered, else the next video frame is not rendered, wherein the computing device comprises a software application that runs in the application layer, wherein the software application generates the render function, and wherein the steps after the initializing step are recursively performed.

14. The method of claim 13 wherein the interrupt signal is periodic and wherein the next system reference time is equal to the system reference time plus a period of time between two consecutive interrupt signals.

15. The method of claim 13 wherein the system reference time is a cumulative value, and wherein the system reference time is a global value that is carried on to a next recursion of the waiting, determining, and rendering steps.

* * * * *